United States Patent [19]

Uchio

[11] Patent Number: 4,783,955

[45] Date of Patent: Nov. 15, 1988

[54] TIRE CORD

[75] Inventor: Takeshi Uchio, Abiko, Japan

[73] Assignee: Tokyo Rope Mfg. Co., Ltd., Tokyo, Japan

[21] Appl. No.: 930,298

[22] Filed: Nov. 13, 1986

[30] Foreign Application Priority Data

Nov. 20, 1985 [JP] Japan ..... 60-260466

[51] Int. Cl.[4] ..... D02G 3/48; D07B 1/06

[52] U.S. Cl. ..... 57/213; 57/230; 57/902

[58] Field of Search ..... 57/902, 212, 213, 214, 57/215, 230; 428/615, 606, 364, 375, 373, 377, 379; 152/359, 356

[56] References Cited

U.S. PATENT DOCUMENTS

| | | | |
|---|---|---|---|
| 3,726,078 | 4/1973 | Nakamura | 57/902 |
| 4,158,946 | 6/1979 | Bourgois | 57/902 |
| 4,332,131 | 6/1982 | Palsky et al. | 57/213 |
| 4,627,229 | 12/1986 | Bourgois | 57/213 |
| 4,628,683 | 12/1986 | Bourgois | 57/213 |

*Primary Examiner*—Lorraine T. Kendell

*Attorney, Agent, or Firm*—Frishauf, Holtz, Goodman & Woodward

[57] ABSTRACT

A cord has a core including a plurality of wires, and an outer layer including a plurality of wires and surrounding the core. The wires of the core and of the outer layer are twisted together. All the wires of the core have a diameter larger than the wires of the outer layer, thereby guaranteeing a gap between adjacent wires of the outer layer.

19 Claims, 1 Drawing Sheet

TIRE CORD

BACKGROUND OF THE INVENTION

1. Field of the Invention

The present invention relates to a cord and, more particularly, to a cord suitably used as a vehicle tire reinforcing material.

2. Description of the Prior Art

A typical conventional tire cord for reinforcing a rubber tire is known, as shown in FIG. 1. In the tire cord, nine peripheral wires $\delta_1$ surround three core wires $\delta_0$. Wires $\delta_1$ and $\delta_0$ are twisted together in one direction to obtain a stranded cord. Wires $\delta_1$ and $\delta_0$ have the same diameter. As is apparent from FIG. 1, wires $\delta_0$ are in tight contact with each other, and at the same time wires $\delta_1$ are in tight contact with each other.

A tire cord embedded in a rubber tire is subjected to repeated bending with compression and tension during rotation of the tire. In the conventional cord described above, displacements of the peripheral wires differ from each other due to changes in compression and tensile stresses, and the adjacent peripheral wires are undesirably brought into contact to cause fretting wear, thereby increasing fatigue of the wires. Since the peripheral wires are in contact with each other, they cannot apply a large tightening force to the core wires. For this reason, the core wires are deviated from the initial positions, and ends of the core wires may stick out from the tire cord to cause a decisive defect in the tire.

In the conventional tire cord described above, since the peripheral wires are in tight contact with each other, rubber cannot sufficiently reach inside the cord due to poor rubber filling. Thus, if the tire is under bad conditions, e.g., if a rubber layer of the tire is damaged, moisture permeates into the cord through the damaged portion of the tire. As a result, the cord rusts, adhesion between the cord and the rubber layer is degraded, and a separation phenomenon occurs.

SUMMARY OF THE INVENTION

It is, therefore, an object of the present invention to provide a cord wherein an anti-fatigue property is improved, deviations of core wires can be prevented, and rubber can be sufficiently filled inside the cord.

According to the present invention, there is provided a cord comprising:

a core including a plurality of wires; and an outer layer including a plurality of wires, the outer layer surrounding the core, the wires of the core and of the outer layer being twisted together, all the wires of the core having a diameter larger than the wires of the outer layer, thereby guaranteeing a gap between adjacent wires of the outer layer.

DESCRIPTION OF THE PREFERRED EMBODIMENTS

The present invention will be described in detail with reference to FIG. 2.

Figure 1:
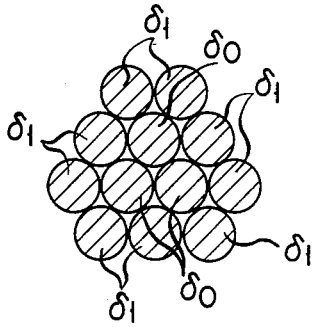
FIG. 1 is a sectional view of a conventional tire cord.
Figure 2:
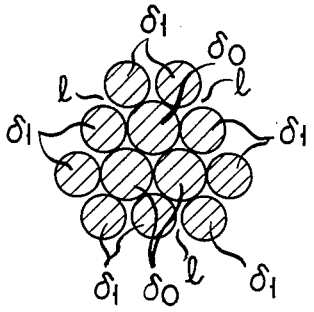
FIG. 2 is a sectional view of a tire cord according to the present invention.

FIG. 2 shows a tire cord having a 1×12 structure according to the present invention. A core comprises three wires $\delta_0$ which are in contact with each other. In other words, each wire $\delta_0$ is in contact with other two wires $\delta_0$. Wires $\delta_0$ constituting the core usually have the same diameter.

An outer layer comprising nine peripheral wires $\delta_1$ surrounds the core. Each peripheral wire $\delta_1$ is in contact with a core wire $\delta_0$, but peripheral wires $\delta_1$ are separated from each other so that gap l is formed between adjacent peripheral wires $\delta_1$. Wires $\delta_1$ have the same diameter.

The cord having the structure described above can be prepared such that the diameter of each wire $\delta_0$ is set to be larger than that of each wire $\delta_1$. Wire $\delta_1$ generally has a diameter of not more than 1 mm, and preferably 0.10 to 0.40 mm and more preferably 0.15 to 0.35 mm. The diameter of wire $\delta_0$ is generally larger than that of wire $\delta_1$ by 4 to 20%, preferably by 8 to 12%.

The above cord can be prepared by arranging peripheral wires $\delta_1$ around core wires $\delta_0$ and twisting wires $\delta_0$ and $\delta_1$ in one direction at identical pitches. In this case, the twisting pitch is generally 10 to 14 times the diameter of the cord.

Core and peripheral wires $\delta_0$ and $\delta_1$ are generally made of a metal such as steel and may be plated with brass. The wires may be plated with zinc or an alloy such as Zn-Co and Cu-Zn-Co.

A wrapping wire (not shown) may be wound around the tire cord, as needed.

Since peripheral wires $\delta_1$ are separated from each other without being in contact, they are not subjected to friction, even if the tire cord is subjected to bending with compression or tension. Therefore, fretting wear can be prevented to improve the anti-fatigue property. In addition, since wires $\delta_1$ are not in tight contact with each other, they can generate a large tightening force for core wires $\delta_0$ surrounded thereby, and deviations of core wires $\delta_0$ can be prevented. Moreover, since gaps are formed between wires $\delta_1$, rubber can sufficiently permeate into the cord in the tire manufacturing process to prevent water from later permeating into the cord during use, and hence prevent the cord from rusting. At the same time, the adhesion strength between the rubber layer and the tire cord is improved to prevent the phenomenon of separation therebetween.

The physical properties of cords of the present invention are compared with those of the conventional cords in Tables 1 to 3. A breaking load test was complied with ASTM D2969-79. A 3-roller bending fatigue test was performed as follows. Each cord was passed through two rollers located on an identical plane and a roller located therebetween and above by 69 mm (the central point reference). One end of the cord was fixed, and the other end was connected to a counterweight through a guide roller. The three rollers and the guide roller are fixed on a supporting plate. The plate was reciprocally moved at a stroke of 60 mm, and the number of reciprocal cycles at the time of breaking of the cord was measured. An air permeability test was performed as follows. A cord was embedded by 14 mm into vulcanized rubber, and the resultant sample was dipper to a depth of about 5 cm in a water tank. Compressed air at a pressure of 0.52 kg/cm was forcibly supplied to the bottom of the sample, and an amount of air passing through the rubber piece was measured by a measuring cylinder.

TABLE 1

| Structure | Wire Diameter (mm) $\delta_1$ | $\delta_0$ | Diameter Increase Ratio ($\delta_0/\delta_1$) | Cord Pitch (mm) | Cord Breaking Load (kgf) | Anti-Fatigue Property* (Cycle) | Rubber Adhesion Strength (Core Pulling Force) (kgf) | Air Permeability (ml/min) |
|---|---|---|---|---|---|---|---|---|
| 1 × 12 | 0.15 | 0.15 | 1.00 | 8.1 | 66 | 32,500 | 10 | 10 |
| 1 × 12 | 0.15 | 0.156 | 1.04 | 8.2 | 68 | 34,900 | 18 | 1 |
| 1 × 12 | 0.15 | 0.162 | 1.08 | 8.0 | 68 | 35,400 | 20 | 0 |
| 1 × 12 | 0.15 | 0.168 | 1.12 | 8.2 | 69 | 35,200 | 22 | 0 |
| 1 × 12 | 0.15 | 0.174 | 1.16 | 8.1 | 70 | 34,150 | 22 | 0 |
| 1 × 12 | 0.15 | 0.180 | 1.20 | 8.0 | 70 | 33,700 | 23 | 0 |
| 1 × 12 | 0.15 | 0.185 | 1.23 | 8.1 | 71 | 28,200 | 23 | 0 |

*Fatigue Test Condition: load of 10 kg

TABLE 2

| Structure | Wire Diameter (mm) $\delta_1$ | $\delta_0$ | Diameter Increase Ratio ($\delta_0/\delta_1$) | Cord Pitch (mm) | Cord Breaking Load (kgf) | Anti-Fatigue Property* (Cycle) | Rubber Adhesion Strength (Core Pulling Force) (kgf) | Air Permeability (ml/min) |
|---|---|---|---|---|---|---|---|---|
| 1 × 12 | 0.25 | 0.25 | 1.00 | 12.7 | 188 | 11,500 | 20 | 26 |
| 1 × 12 | 0.25 | 0.26 | 1.04 | 12.8 | 189 | 12,400 | 48 | 18 |
| 1 × 12 | 0.25 | 0.27 | 1.08 | 12.8 | 190 | 12,500 | 51 | 16 |
| 1 × 12 | 0.25 | 0.28 | 1.12 | 12.5 | 193 | 12,200 | 56 | 16 |
| 1 × 12 | 0.25 | 0.29 | 1.16 | 12.3 | 196 | 12,000 | 61 | 17 |
| 1 × 12 | 0.25 | 0.30 | 1.20 | 12.4 | 198 | 11,900 | 63 | 16 |
| 1 × 12 | 0.25 | 0.31 | 1.24 | 12.7 | 202 | 9,800 | 65 | 16 |

*Fatigue Test Condition: load of 19 kg

TABLE 3

| Structure | Wire Diameter (mm) $\delta_1$ | $\delta_0$ | Diameter Increase Ratio ($\delta_0/\delta_1$) | Cord Pitch (mm) | Cord Breaking Load (kgf) | Anti-Fatigue Property* (Cycle) | Rubber Adhesion Strength (Core Pulling Force) (kgf) | Air Permeability (ml/min) |
|---|---|---|---|---|---|---|---|---|
| 1 × 12 | 0.35 | 0.35 | 1.00 | 18.5 | 363 | 2,750 | 13 | 139 |
| 1 × 12 | 0.35 | 0.365 | 1.04 | 18.5 | 368 | 3,020 | 86 | 100 |
| 1 × 12 | 0.35 | 0.38 | 1.09 | 18.3 | 372 | 3,030 | 86 | 75 |
| 1 × 12 | 0.35 | 0.39 | 1.11 | 18.6 | 375 | 2,980 | 86 | 70 |
| 1 × 12 | 0.35 | 0.405 | 1.16 | 18.6 | 383 | 2,910 | 90 | 60 |
| 1 × 12 | 0.35 | 0.420 | 1.20 | 18.5 | 387 | 2,870 | 91 | 45 |
| 1 × 12 | 0.35 | 0.435 | 1.24 | 18.6 | 389 | 2,470 | 92 | 45 |

*Fatigue Test Condition: load of 36 kg

As is apparent from the results in Tables 1 to 3, the tire cords of the present invention have good anti-fatigue properties, high adhesion strength with rubber and lower air permeability, as compared with the conventional cords. In particular, when the diameter of each core wire is larger by 4 to 20% than that of each peripheral wire, all physical properties of the cords of the present invention are better than those of the conventional cords.

What is claimed is:

1. A cord comprising:

a core comprising a plurality of wires; and an outer layer comprising a plurality of wires, said outer layer surrounding said core;

said wires of said core and of said outer layer being twisted together in the same twisting direction and at the same pitch; and all of said wires of said core having a diameter larger than the diameters of said wires of said outer layer, thereby providing a gap between adjacent said wires of said outer layer.

2. A cord according to claim 1, wherein said core consists of three wires and said outer layer consists of nine wires.

3. A cord each according to claim 2, wherein said wires constituting said core have an identical diameter, and said wires constituting said outer layer each have another identical diameter.

4. A cord according to claim 2, wherein the diameters of said wires constituting said core are larger by 4 to 20% than the diameters of said wires constituting said outer layer.

5. A cord according to claim 1, wherein said wires constituting said core are in contact with each other.

6. A cord according to claim 1, wherein said wires constituting said outer layer have a diameter of not more than 1 mm.

7. A cord according to claim 6, wherein said wires constituting said outer layer have a diameter falling within a range of 0.01 to 0.40 mm.

8. A cord according to claim 6, wherein said wires constituting said outer layer have a diameter falling within a range of 0.15 to 0.35 mm.

9. A cord according to claim 1, wherein said wires constituting said core and said outer layer are made of a metal.

10. A cord according to claim 9, wherein said wires constituting said core and said outer layer are made of steel.

11. A cord according to claim 9, wherein said wires constituting said core and said outer layer respectively comprise brass-plated steel wires.

12. A cord according to claim 1, wherein said core comprises at least three wires, and wherein said outer layer comprises at least nine wires.

13. A cord according to claim 12, wherein said wires constituting said core each have an identical diameter, and said wires constituting said outer layer each have another identical diameter.

14. A cord according to claim 12, wherein the diameters of said wires constituting said core are larger by 4 to 20% than the diameters of said wires constituting said outer layer.

15. A cord according to claim 12, wherein said wires constituting said core are in line contact with each other.

16. A cord according to claim 12, wherein said wires constituting said outer layer have a diameter of not more than 1 mm.

17. A cord according to claim 16, wherein said wires constituting said outer layer have a diameter falling within a range of 0.01 to 0.40 mm.

18. A cord according to claim 12, wherein said wires constituting said core and said outer layer are made of a metal.

19. A cord according to claim 1, wherein said wires constituting said core are in line contact with each other.

* * * * *